United States Patent [19]

Lange

[11] Patent Number: 5,069,059

[45] Date of Patent: Dec. 3, 1991

[54] POSITIONING DEVICE FOR ARRANGING ELONGATED WORKPIECES AND THE USE OF SUCH A DEVICE IN A WIRE-WORKING MACHINE

[75] Inventor: Gerhard Lange, Reutlingen, Fed. Rep. of Germany

[73] Assignee: WAFIOS Maschinenfabrik GmbH & Co. Kommanditgesellschaft, Fed. Rep. of Germany

[21] Appl. No.: 544,928

[22] Filed: Jun. 28, 1990

[30] Foreign Application Priority Data

Jul. 8, 1989 [DE] Fed. Rep. of Germany ..... 3922529

[51] Int. Cl.[5] ..... B21D 43/02; B21G 3/20

[52] U.S. Cl. ..... 72/421; 10/162 A; 10/44

[58] Field of Search ..... 10/49, 50, 51, 30, 43, 10/44, 47, 57, 162 R, 162 A; 29/33 D, 33 F, 33 P, 33 T; 72/419, 420, 421, 422, 361; 227/40, 135

[56] References Cited

U.S. PATENT DOCUMENTS

| | | | |
|---|---|---|---|
| Re. 22,106 | 6/1942 | McCreary | 72/361 X |
| 979,457 | 12/1910 | Francis | 10/49 X |
| 1,894,526 | 1/1933 | Wilcox | 72/421 X |
| 3,017,984 | 1/1962 | Willard et al. | 72/421 X |
| 4,270,651 | 6/1981 | Ragard et al. | 198/456 |
| 4,737,227 | 4/1988 | Foster et al. | 156/297 |

FOREIGN PATENT DOCUMENTS

| | | | |
|---|---|---|---|
| 49164 | 10/1889 | Fed. Rep. of Germany . | |
| 142069 | 6/1903 | Fed. Rep. of Germany . | |
| 643918 | 4/1937 | Fed. Rep. of Germany . | |
| 238936 | 9/1986 | Fed. Rep. of Germany . | |
| 54-117995 | 9/1979 | Japan | 29/33 T |
| 742013 | 6/1980 | U.S.S.R. | 10/44 |

OTHER PUBLICATIONS

Nail Machine Revolution in Wire Technology, 2455 Wire Industry, vol. 48 (1981), pp. 411, 413.

*Primary Examiner*—Lowell A. Larson
*Assistant Examiner*—Michael J. McKeon
*Attorney, Agent, or Firm*—Wigman & Cohen

[57] ABSTRACT

A positioning device for arranging elongated workpieces, such as wire pieces which are to be worked up into headed nails, and the use of such a device in a wire-working machine, includes at least one positioning tool for displacing at least one workpiece in its axial direction by a predetermined distance. The tool is a rigid body which is displaceable parallel to its longitudinal direction. The positioning device may include an additional positioning tool to push the workpieces slightly backward, to compensate for any tolerances in the nominal length of the workpieces of each batch of workpieces.

2 Claims, 1 Drawing Sheet

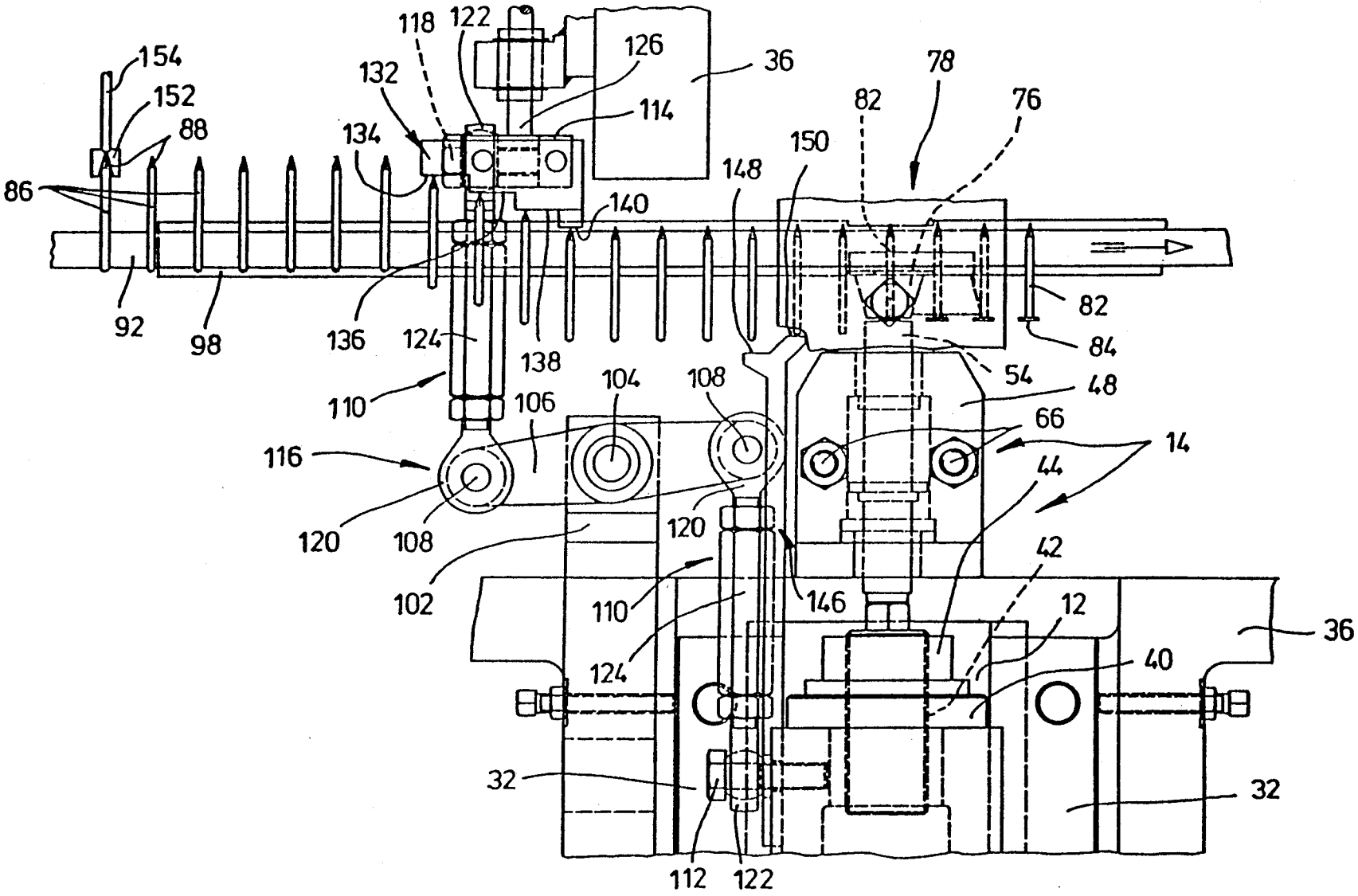
36
32
14
40
12
42
44
66
48
54
84
82
76
78
82
150
146
148
36
108
120
122
112
126
114
140
104
110
124
138
106
122
118
132
134
136
124
110
116
120
108
102
32
98
154
152
88
92
86

POSITIONING DEVICE FOR ARRANGING ELONGATED WORKPIECES AND THE USE OF SUCH A DEVICE IN A WIRE-WORKING MACHINE

CROSS REFERENCES TO RELATED APPLICATIONS

This application is subject matter related to commonly assigned copending U.S. application Ser. No. (not yet assigned) filed June 8, 1990 for "Conveyor Device for Transporting Elongated Workpieces such as Wire Pieces and the Use of Such a Device in a Wire Working Nail Press"; copending U.S. application Ser. No. (not yet assigned) filed June 8, 1990 for "Upsetting Device for Upsetting the Ends of Elongated Workpieces such as Wire Pieces and Use of such a Device in a Wire-Working Nail Press"; and U.S. application filed concurrently herewith for "Apparatus for the Working of Wire Pieces and the Use of such Apparatus".

BACKGROUND OF THE INVENTION

1. Field of the Invention

The invention relates to a positioning device for arranging elongated workpieces, in particular to a wire-working machine, as well as to the use of such device, and more particularly to a nail press used as apparatus for the production of wire nails, especially headed nails.

2. Description of the Prior Art

Belonging to the state of the art are various devices by means of which elongated workpieces such as wire pieces which are to be worked up, for example, into headed nails, can be adjusted to a particular position in their longitudinal direction.

SUMMARY AND OBJECTS OF THE INVENTION

It is an object of the present invention to exactly position, in its longitudinal direction, one end of each of a succession of elongated workpieces following one upon the other in their transverse direction, regardless of the actual length of the workpiece.

This problem is solved by means of at least one positioning tool for displacing at least one workpiece in its axial or longitudinal direction by a predetermined amount, this tool being a rigid body which is displaceable parallel to its longitudinal direction.

The advantage of this solution to the problem is that workpieces can be positioned so accurately regardless of any difference in length between two different batches of workpieces that they are all in the same position at one end while the other ends of the workpieces show the differences in length. At one of their ends, therefore, the workpieces can all be worked in the same position.

With the aid of such a device, elongated workpieces such as wire pieces which, for example, are to be formed into headed nails, can be positioned so accurately regardless of any difference in length between two different batches of workpieces that they are all in alignment at one end while the differences in length are displayed at their other ends.

If, in addition, the second of two positioning tools working in opposite directions can push the workpieces slightly back, as in the exemplary embodiment of the positioning device according to the invention described and illustrated here, the arrangement can automatically compensate for any tolerances in the nominal length of the workpieces of one and the same batch.

With the foregoing and other objects, advantages and features of the invention that will become hereinafter apparent, the nature of the invention may be more clearly understood by reference to the following detailed description of the invention, the appended claims and to the several views illustrated in the attached drawings.

BRIEF DESCRIPTION OF THE DRAWING

The single Figure of the drawing is a broken top plan view of the device made in accordance with the invention.

DETAILED DESCRIPTION OF THE PREFERRED EMBODIMENT

A carriage (12) of an upsetting device (14) constituting part of an apparatus for the production of wire nails (82) is connected to a connecting rod by a pin mounted in the forked end (not shown) of the carriage (12). This connecting rod is held by means of a connecting rod cover on a short-stroke crank pin of a drive shaft of the apparatus. The carriage (12), which is shown in its forward operating position, has a dovetail guide over its whole length and is mounted to be slidably guided between two guide bars (32) on a baseplate in the machine frame (36). An internally threaded flange (40) is attached to the end of the carriage (12) shown in the drawing and engages with an adjustment screw (42) which is secured by a ring nut (44).

An upsetting tool (54) loaded by a compression spring and forming part of the upsetting device (14) is slidably mounted to be longitudinally displaceable in bearing bushes provided in a separate support (48) in the axial extension to the adjustment screw (42).

The support (48) with the floatingly mounting upsetting tool (54) is attached to the machine frame (36) by two stud bolts (66) so that it can easily be removed or replaced. A restoring spring serves to keep the upsetting tool (54) permanently in frictional contact with the hexagon head of the adjustment screw (42). Also situated in the extension of the axis of the upsetting tool (54) and immediately in front of this tool and arranged symmetrically on either side of this axis are two cooperating clamping tools (76), moving in opposite directions, of a clamping device (78) of the apparatus for producing wire nails (82), each of these clamping tools (76) being mounted in a lever of a carriage. The drawing shows a wire nail (82) with upset head (84) firmly clamped between the clamping tools (76).

The shank of the wire nail (82) projecting from the clamping tools (76) lies firmly clamped in the gaps between the teeth of two toothed belts serving as the conveyor belts of a conveyor device shown at the top, forming part of the apparatus for the manufacture of wire nails. By means of these two toothed belts, of which only the lower (92) belt is shown, the nail blanks (86) on which no head (84) is yet formed are moved intermittently towards and away from a position which is exactly central in front of the upsetting tool (54) of the upsetting device (14) in both the horizontal and the vertical plane. For this purpose, the toothed belts (e.g., 92) move stepwise transversely to the direction of upsetting and clamping of the upsetting and clamping devices (14, 78). Each toothed belt is provided with a vertically adjustable guide rail, of which only the lower rail (98) is shown. These rails enable the distance between the toothed belts and hence the tension with which the nail blanks (86) are held in the gaps between the teeth to be adjusted. Further, lateral supporting surfaces on the guide rails (e.g., 98) serve to carry the toothed belts along their path without lateral displacement.

A rocking lever (106) is mounted on a pin (104) in a bearing (102) at the front part of the guide for the carriage (12). Each arm of this lever (106) is acted upon by a connecting rod (110) by way of a pin (108) so that the rocking lever (106) is coupled at one end thereof to the carriage (12) of the upsetting device (14) by way of a pin (112) and at the other end to a tool holder (114) of a positioning device (116) for the nail blanks (86) by means of a pin (118). Each of the connecting rods (110) has two joint heads (120, 122) connected together by a tension lock (124).

The tool holder (114) is supported to be longitudinally displaceable in the machine frame (36) by two rods (126) placed one below the other. The holder (114) carries a positioning tool (132) which has four working surfaces (134 to 140) for a four-stage positioning process during which the longitudinal position of the nail blanks (86) can be altered.

An additional positioning tool (146) longitudinally displaceable in a slot is clamped to the carriage (12) by means of the pin (112) which also fixes the joint head (122). This positioning tool (146) has only two working surfaces (148 and 150) for axially displacing the nail blanks (86) in a direction opposited to that in which the first positioning tool (132) displaces the blanks. The lower of two cutting tools (152) acting against one another of a cutting device forming part of the apparatus for producing wire nails and serving to cut the wire (154) to the required lengths and form pyramidal tips (88) to the wire blanks (86) is shown at the very left-hand end of the Figure.

The positioning device described above operates as follows if it forms part of an apparatus (partly illustrated) for the manufacture of wire nails:

A take-in device known per se but not illustrated draws the wire (154) from the wire supply and through a straightening apparatus and pushes so much wire through the opened cutting tools (152) and into the gaps between the teeth of the two toothed belts (e.g., 92) as is required for the desired length of the wire nail and for forming the head (84) of the nail. The cooperating cutting tools (152) moving in opposite directions, each of which may be mounted in a lever or in a carriage, now sever the wire (154) in such a manner as to form a pyramidal tip (88) to the wire nail. While the nail (154) is being pushed between the two toothed belts and cut off, the intermittent drive to the pair of toothed belts is briefly at a standstill. Thereafter, the drive is briefly switched on again, whereby the pair of toothed belts is moved forwards by one step and the drive is stopped again before a fresh length of wire is fed forwards (a stepping mechanism could be used for this alternating stopping and starting). This process is repeated until a measured length of nail blank (86) comes to lie between the climbing tools (76) of the clamping device (78) and centrally in front, of the upsetting tool (54) of the upsetting device (14).

In order that the apparatus may be suitable for producing a wide range of lengths of nails without major conversion work in spite of the fact that the cutting tools (152) of the cutting device and the clamping and upsetting device (78, 14) of the apparatus for producing wire nails (82) are fixed in position, the difference in the distance between the tip (88) of the wire nail and the upsetting tool (54) when producing a nail of different length is compensated for by displacing the nail blanks (86) in their longitudinal direction within the conveyor path between the cutting station and the station for forming the head by upsetting. This is carried out as follows:

The nail blanks (86) are positioned by the two positioning tools (132 and 146) of the positioning device (116), the first tool (132) having four working surfaces (134 to 140) for pushing the nails forward stepwise. The stepwise positioning takes place with each forward stroke of the carriage (12). During the forward movement of the carriage (12), i.e., during the formation of each nail head (84), the positioning tool (132) which is supported in the machine frame (36) is moved towards the conveyor device by way of the connecting rod (110) and the rocking lever (106) so that the nail blank (86) which at that moment is in front of the first working surface (134) of the positioning tool (132) is pushed forwards by a certain amount. As already mentioned, the coveyor device is at a standstill at this stage. While the carriage (12) is moving backwards, the drive is briefly switched on for a period of transport so that the nail blank (86) which has previously been pushed forwards by the working surface (134) of the tool (132) is now brought in front of the second working surface (132) is now brought in front of the second working surface (136) and is pushed forwards by the same amount during a fresh upsetting operation. These movements are repeated until the nail blank (86) has been pushed into its furtherest forward position by the fourth working surface (140) of the positioning tool (132). When the nail blank (86) is in this longitudinal position, it is carried stepwise in the direction towards the upsetting station until it lies in front of the working surface (150) of the second positioning tool (146). The nail blank (86) may now if necessary be moved slightly backwards by the working surface (150) to compensate for tolerances in lengths of the blanks so that the blank can take up its final position. This movement is also derived from the upsetting movement of the carriage (12) and in the example illustrated here the nail blank is brought into such a position between the clamping tools (76) after two phases of transport that the length of wire projecting from the clamping jaws (76) is exactly the amount required for forming the head (84) of the wire nail. If the nail blanks (86) are exceptionally long, their displacement backwards by the second positioning tool (146) takes place in two stages, the blank being first moved back by the working surface (148) and thereafter into its final position by the working surface (150).

When the clamping jaws (76) then close up, they firmly hold the blank (86) in position for the following upsetting process for producing the head (84) of the nail. For this purpose, the drive shaft is set in motion to impart a reciprocating movement to the carriage (12). The upsetting tool (54), which is connected non-positively to the hexagon of the adjustment screw (42) by the restoring spring, participates in this reciprocating movement and with each forward movement it produces a head (84) on the nail blank (86), the clamping tools (76) serving as anvil. With each backward movement of the carriage (12), the compression spring relaxes and pushes the upsetting tool (54) back so that the latter remains in permanent frictional contact with the adjustment screw (42). The magnitude of the upsetting pressure (and hence also the form of the nail head) may be adjusted by turning the adjustment screw (42) in the threaded flange (40) of the carriage (12) by varying amounts.

One complete wire nail (82) is moved out of the range of the tools with each transport step while a fresh nial blank (86) is moved between the tools (54 and 76) and the process then begins again from the beginning. After several transport phases, the completed nails (82) are securely discharged at the end of the conveyor path over a chute without the aid of an ejector device or alternatively the completed nails arriving in a row may automatically be removed singly for storage or other processing and carried away.

Although only preferred embodiments are specifically illustrated and described herein, it will be appreciated that many modifications and variations of the present invention are possible in light of the above teachings and within the purview of the appended claims without departing from the spirit and intended scope of the invention.

What is claimed is:

1. A positioning device for arranging elongated workpieces such as wire pieces each having an axial direction along their respective axes, said workpieces being successively movable perpendicular to their parallel axes from one working station to another working station and being displaceable in batches during movement between the two stations, said workpieces each having a worked end and an unimpacted end, comprising:

at least one positioning tool for displacing at least one workpiece in the axial direction of said at least one workpiece by a predetermined distance, said tool being a rigid body which is displaceable parallel to the axial direction of the workpiece to be displaced between the two working stations independent of lateral guiding perpendicular to said axial direction;

wherein the positioning tool, which is rigid in itself, has at least two working surfaces which are displaceable parallel to the axial directions of the workpieces and one of which, in the course of the working stroke of said positioning tool, acts upon and carries with it the end of a workpiece lying in its path;

wherein the positioning tool which is disposed between said two working stations at the line of movement of said workpieces is without stop for the unimpacted end of the workpiece acted upon; and wherein the positioning tool has at least one step connecting together and two working surfaces which are adjacent.

2. The positioning device according to claim 1, further including a machine frame supporting said positioning tool, wherein the positioning tool is guided by means of two parallel rods mounted on the machine frame.

* * * * *